US007683556B2

(12) United States Patent
Aoi et al.

(10) Patent No.: US 7,683,556 B2
(45) Date of Patent: Mar. 23, 2010

(54) SYSTEM WITH ACCELERATION TUBE CONDITIONING APPARATUS AND ACCELERATION TUBE CONDITIONING METHOD

(75) Inventors: Tatsufumi Aoi, Hiroshima (JP); Kuniyuki Kajinishi, Hiroshima (JP); Ichiro Yamashita, Hiroshima (JP); Susumu Urano, Hirashima (JP); Shinji Nomura, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 341 days.

(21) Appl. No.: 11/905,411

(22) Filed: Sep. 28, 2007

(65) Prior Publication Data

US 2008/0191645 A1 Aug. 14, 2008

(30) Foreign Application Priority Data

Feb. 8, 2007 (JP) ..... 2007-029729

(51) Int. Cl.
*H05H 9/00* (2006.01)

(52) U.S. Cl. ..... 315/505; 315/500; 250/505.1

(58) Field of Classification Search ..... 315/500, 315/505, 506; 250/492.1, 492.3, 505.1
See application file for complete search history.

(56) References Cited

U.S. PATENT DOCUMENTS 5,107,222 A * 4/1992 Tsuzuki ..... 315/500
5,216,255 A * 6/1993 Weidlich ..... 250/492.3
6,483,263 B1 11/2002 Hanna et al.
6,856,105 B2 * 2/2005 Yao et al. ..... 315/505
7,432,672 B2 * 10/2008 Meddaugh et al. ..... 315/505
7,471,053 B2 * 12/2008 Miyake ..... 315/501
7,576,499 B2 * 8/2009 Caporaso et al. ..... 315/505

FOREIGN PATENT DOCUMENTS

JP 2-66899 A 3/1990

OTHER PUBLICATIONS

S.M Hanna, et al. "Automated High-Power conditioning of medical accelerators" (Proceedings of EPAC 2004).

* cited by examiner

*Primary Examiner*—Thuy Vinh Tran
(74) *Attorney, Agent, or Firm*—Birch, Stewart, Kolasch & Birch LLP

(57) ABSTRACT

In an acceleration tube conditioning apparatus for performing a conditioning process on an acceleration tube when a high frequency power signal to be supplied to an acceleration tube is generated by a high frequency power supply, a power value collecting section collects a traveling wave power value and a reflection wave power value from a sensor which monitors the traveling wave power signal and the reflection wave power signal. A high frequency calculating section calculates a resonance frequency of the acceleration tube based on the traveling wave power value and the reflection wave power value. A high frequency adjusting section determines a high frequency value based on one of the traveling wave power value and the reflection wave power value as a selection power value, and a high frequency power supply control unit controls the high frequency power supply based on the high frequency value. The high frequency value indicates a constant value when the selection power value is smaller than a predetermined value, and indicates the calculated resonance frequency when the selection power value is larger than the predetermined value.

17 Claims, 7 Drawing Sheets

SYSTEM WITH ACCELERATION TUBE CONDITIONING APPARATUS AND ACCELERATION TUBE CONDITIONING METHOD

BACKGROUND OF THE INVENTION

1. Field of the Invention

The present invention relates to an acceleration tube conditioning system with an acceleration tube conditioning apparatus and an acceleration tube conditioning method.

2. Description of the Related Art

There are known acceleration tubes to accelerate charged particles such as electrons. Such acceleration tubes are applied to a radiotherapy system, a non-destructive inspection system, and a sterilization system. In the radiotherapy system, therapeutic radiation generated by bremsstrahlung of the accelerated electrons is irradiated to a deceased area (or tumors) in order to treat patients. In the non-destructive inspection system, radiation generated by bremsstrahlung of the accelerated charged particles transmits an inspection target and transmission images are obtained for examination of the examination target. In the sterilization system, the accelerated charged particles are irradiated onto a sterilization target or radiation generated by bremsstrahlung of the accelerated charged particles is irradiated onto a sterilization target in order to sterilize the sterilization target.

In such an acceleration tube, a plurality of electrodes are provided to accelerate charged particles which are inputted into an acceleration tube and accelerated with high frequency power applied to the acceleration tubes. In such an acceleration tube, conditioning (i.e., aging operation) is performed before using charged particles. The conditioning is a process of cleaning the internal surface of the tube by supplying high frequency power to the acceleration tube while vacuuming an atmosphere inside the tube, to generate appropriate arc discharge on a surface of internal walls of the acceleration tube so that some kind of contaminants and electron emitter absorbed in the surface can be removed (for example, refer to "Automated High-Power conditioning of medical accelerators" (Proceedings of EPAC 2004) by S. M. Hanna, et. al.

The conditioning process is performed continuously day and night to allow continuous maintenance of a high surface activity state of the acceleration tube, so that a process can be efficiently performed. The conditioning process is performed in manual, by detecting an RF reflection wave visually, by monitoring a current of an ion pump provided in the acceleration tube to confirm generation of discharge, and by changing a high frequency input condition into the acceleration tube. In this manual operation, a work load is high and there are variations in a change time and a change amount depending on persons, so that it is difficult to sustain a constant process condition. Automatic implementation of such a conditioning process of an acceleration tube is demanded, and a more certain conditioning process of the acceleration tube is demanded.

SUMMARY OF THE INVENTION

An object of the present invention is to provide an acceleration tube conditioning system with an acceleration tube conditioning apparatus and an acceleration tube conditioning method, in which an acceleration tube is automatically and stably and reliably conditioned to accelerate charged particles based on a high frequency input power.

Also, another object of the present invention is to provide an acceleration tube conditioning system with an acceleration tube conditioning apparatus and an acceleration tube conditioning method, in which a damage of an acceleration tube which accelerates charged particles based on a high frequency input power can be prevented.

In an aspect, the present invention is related to an acceleration tube conditioning apparatus for performing a conditioning process on an acceleration tube when a high frequency power signal to be supplied to an acceleration tube is generated by a high frequency power supply, wherein the high frequency power signal is supplied to the acceleration tube as a traveling wave power signal and the traveling wave power signal is reflected in the acceleration tube as a reflection wave power signal. The acceleration tube conditioning apparatus includes a power value collecting section configured to collect a traveling wave power value and a reflection wave power value from a sensor which monitors the traveling wave power signal and the reflection wave power signal; a high frequency calculating section configured to calculate a resonance frequency of the acceleration tube based on the traveling wave power value and the reflection wave power value; a high frequency adjusting section configured to determine a high frequency value based on one of the traveling wave power value and the reflection wave power value as a selection power value; and a high frequency power supply control unit configured to control the high frequency power supply based on the high frequency value. The high frequency value indicates a constant value when the selection power value is smaller than a predetermined value, and indicates the calculated resonance frequency when the selection power value is larger than the predetermined value.

In another aspect, the present invention is related to an acceleration tube conditioning apparatus for performing a conditioning process on an acceleration tube when a high frequency power signal to be supplied to an acceleration tube is generated by a high frequency power supply, wherein the high frequency power signal is supplied to the acceleration tube as a traveling wave power signal and the traveling wave power signal is reflected in the acceleration tube as a reflection wave power signal. The acceleration tube conditioning apparatus includes a power value collecting section configured to collect a traveling wave power value and a reflection wave power value from a sensor which monitors the traveling wave power signal and the reflection wave power signal; a high frequency calculating section configured to determine a resonance frequency of the acceleration tube based on the traveling wave power value and the reflection wave power value; a high frequency adjusting section configured to generate a high frequency value based on a repetition frequency when the high frequency power supply generates the high frequency power signal intermittently and periodically; and a high frequency power supply control unit configured to control the high frequency power supply based on the high frequency value. The high frequency value indicates a constant value when the repetition frequency is smaller than a predetermined value, and indicates the resonance frequency of the acceleration tube when the repetition frequency is larger than the predetermined value.

In still another aspect of the present invention, an acceleration tube conditioning system includes an acceleration tube; a high frequency power supply configured to generate a high frequency power signal; a sensor configured to measure a traveling wave power value or reflection wave power value of the high frequency power signal in the acceleration tube; and an acceleration tube conditioning apparatus configured to control the high frequency power supply. The acceleration tube conditioning apparatus includes a power value collecting section configured to collect the traveling wave power value and the reflection wave power value from the sensor; a high frequency calculating section configured to calculate a resonance frequency of the acceleration tube based on the traveling wave power value and the reflection wave power value; and a high frequency adjusting section configured to determine a high frequency value; and a high frequency power supply control unit configured to control the high frequency power supply based on the high frequency value.

In still another aspect, the present invention is directed to an acceleration tube conditioning method of performing a conditioning process on an acceleration tube when a high frequency power signal to be supplied to an acceleration tube is generated by a high frequency power supply, wherein the high frequency power signal is supplied to the acceleration tube as a traveling wave power signal and the traveling wave power signal is reflected in the acceleration tube as a reflection wave power signal. The acceleration tube conditioning method is achieved by collecting a traveling wave power value and a reflection wave power value from a sensor which monitors the traveling wave power signal and the reflection wave power signal; by calculating a resonance frequency of the acceleration tube based on the traveling wave power value and the reflection wave power value; by determining a high frequency value based on one of the traveling wave power value and the reflection wave power value as a selection power value; and by controlling the high frequency power supply based on the high frequency value. The high frequency value indicates a constant value when the selection power value is smaller than a predetermined value, and indicates the calculated resonance frequency when the selection power value is larger than the predetermined value.

In still another aspect, the present invention is directed to an acceleration tube conditioning method of performing a conditioning process on an acceleration tube when a high frequency power signal to be supplied to an acceleration tube is generated by a high frequency power supply, wherein the high frequency power signal is supplied to the acceleration tube as a traveling wave power signal and the traveling wave power signal is reflected in the acceleration tube as a reflection wave power signal. The acceleration tube conditioning method is achieved by collecting a traveling wave power value and a reflection wave power value from a sensor which monitors the traveling wave power signal and the reflection wave power signal; by determining a resonance frequency of the acceleration tube based on the traveling wave power value and the reflection wave power value; by determining a high frequency value based on a repetition frequency when the high frequency power supply generates the high frequency power signal intermittently and periodically; and by controlling the high frequency power supply based on the high frequency value. The high frequency value indicates a constant value when the repetition frequency is smaller than a predetermined value, and indicates the resonance frequency of the acceleration tube when the repetition frequency is larger than the predetermined value.

DESCRIPTION OF THE PREFERRED EMBODIMENTS

Figure 1:
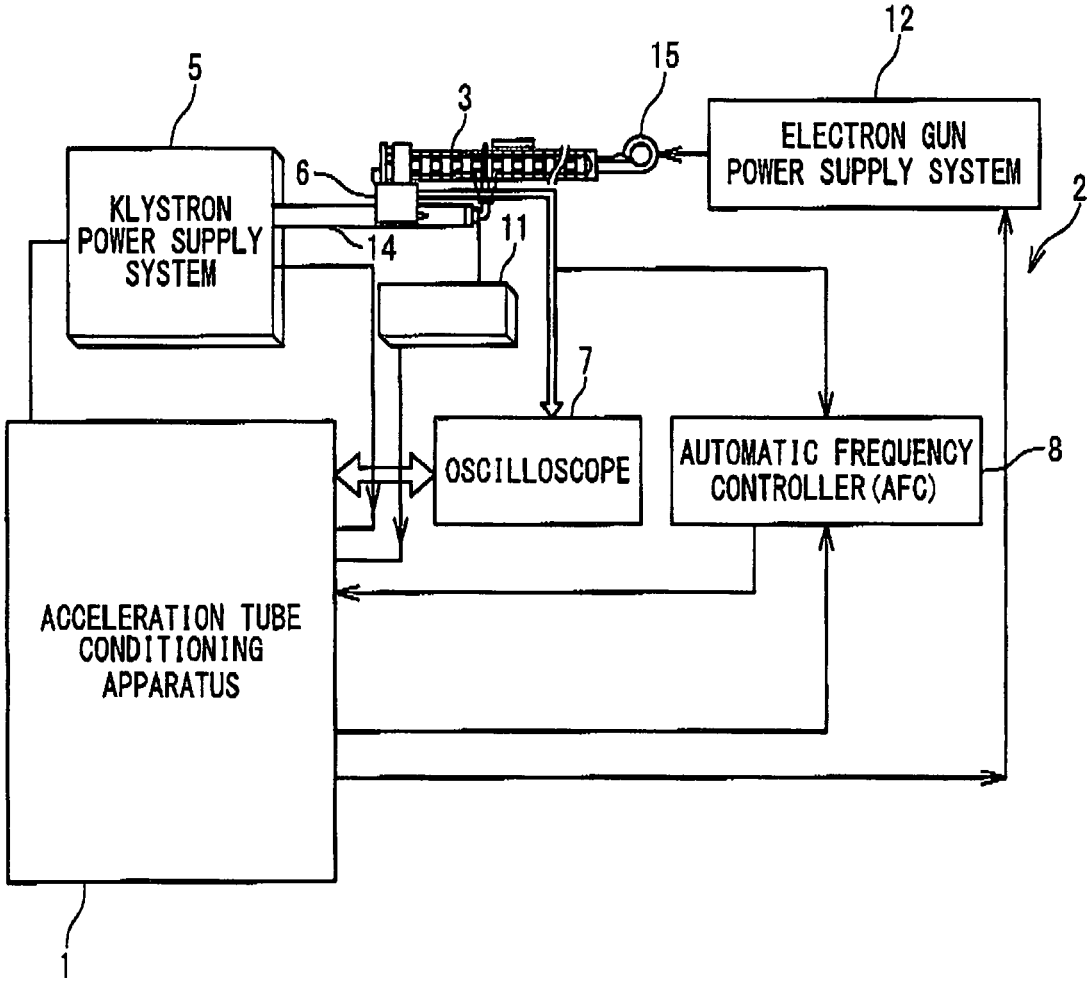
FIG. 1 is a block diagram showing a configuration of an acceleration tube conditioning system to which an acceleration tube conditioning apparatus is applied according to the present invention.

Hereinafter, an acceleration tube conditioning apparatus according to the present invention will be described with reference to the attached drawings. The acceleration tube conditioning apparatus 1 is applied to an acceleration tube conditioning system 2 as shown in FIG. 1. The acceleration tube conditioning system 2 is used for conditioning an acceleration tube 3, and includes the acceleration tube conditioning apparatus 1, a klystron power supply system 5, a traveling wave/reflection wave power monitoring device 6, an oscilloscope 7, an automatic frequency controller 8, an ion pump 11, and an electron gun power supply system 12.

The acceleration tube conditioning apparatus 1 controls an RF power, a klystron voltage, a repetition frequency, a pulse width and a frequency so that the klystron power supply system 5 generates a predetermined high frequency powers which is outputted to the acceleration tube 3 through a waveguide 14. Moreover, the klystron power supply system 5 outputs a klystron monitor signal to the acceleration tube conditioning apparatus 1. The klystron monitor signal includes signals indicating the RF power, the klystron voltage, a klystron current, the pulse width, the repetition frequency, and the frequency. The traveling wave/reflection wave power monitoring device 6 is disposed in the waveguide 14 in the vicinity of the acceleration tube 3, and measures traveling wave power which propagates in the waveguide 14 from the klystron power supply system 5 to the acceleration tube 3, and reflection wave power which propagates in the waveguide 14 from the acceleration tube 3 to the klystron power supply system 5. The traveling wave/reflection wave power monitoring device 6 outputs the measurement results to the oscilloscope 7. The oscilloscope 7 has a display unit and calculates a waveform indicating change in traveling wave power measured by the power monitoring device 6, and a waveform indicating change in reflection wave power measured by the power monitoring device 6, to display these waveforms on the display unit. The oscilloscope 7 outputs these waveforms to the acceleration tube conditioning apparatus 1. The automatic frequency controller 8 is controlled by the acceleration tube conditioning apparatus 1 to calculate a frequency corresponding to the powers measured by the power monitoring device 6 and output the calculation result to the acceleration tube conditioning apparatus 1. The frequency is calculated so as to resonate in the acceleration tube 3 or to suppress resonance deviation. The automatic frequency controller 8 controlled by the acceleration tube conditioning apparatus 1 to generate a power signal of a constant high frequency independently from the powers measured by the power monitoring device 6.

The acceleration tube 3 has a cylindrical structure and provided with a plurality of electrodes (not shown) arranged in a cylinder in an appropriate interval. The acceleration tube 3 includes an electron gun 15. The electron gun 15 is provided with a cathode and a grid structure (both not shown). The electron gun power supply system 12 is controlled by the acceleration tube conditioning apparatus 1 to supply power to the cathode. The electron gun power supply system 12 is controlled by the acceleration tube conditioning apparatus 1 to apply a predetermined voltage between the grids and the cathode. By supplying the appropriate power to the cathode and applying an appropriate voltage between the grid and the cathode by the electron gun power supply system 12, the electron gun 15 discharges a predetermined amount of electrons inside the cylinder of the acceleration tube 3. The high frequency power is inputted into the acceleration tube 3 to apply predetermined voltages to the plurality of electrodes and the electrons discharged from the electron gun 15 are accelerated.

The ion pump 11 is controlled by the acceleration tube conditioning apparatus 1 to evacuate gas inside the cylinder of the acceleration tube 3 by ionizing the gas. Moreover, the ion pump 11 outputs an ion pump current for use in the ionization. The ion current corresponds to a vacuum degree inside the cylinder of the acceleration tube 3, i.e. being substantially proportional to the vacuum degree.

Figure 2:
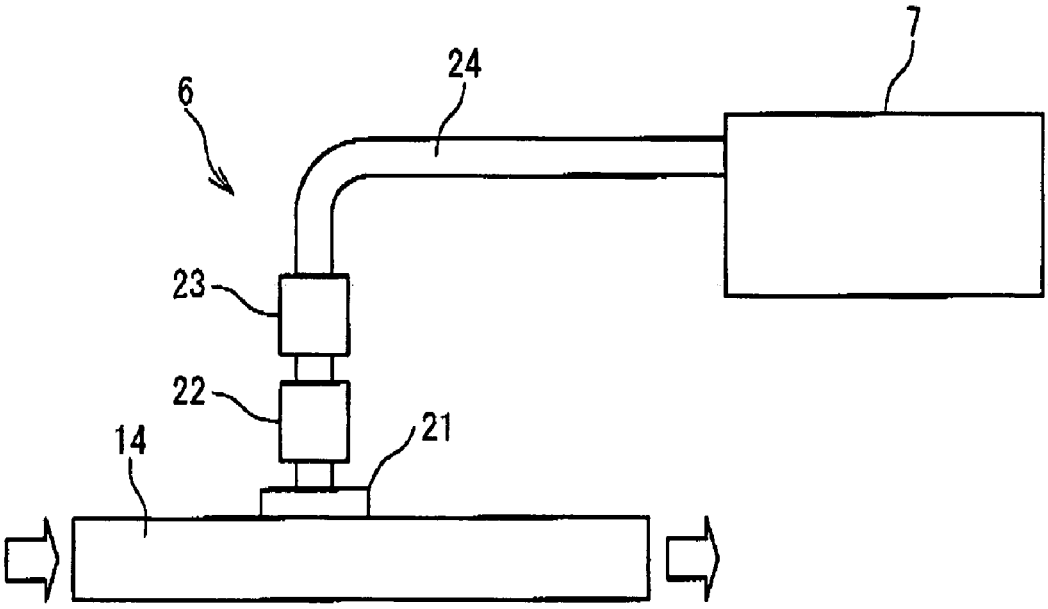
FIG. 2 is a diagram showing a traveling wave/reflection wave power monitoring device.

FIG. 2 partially shows the traveling wave/reflection wave power monitoring device 6. The power monitoring device 6 is provided with a Bethe hole 21, an atteneuator 22, a crystal element 23, and a coaxial cable 24. The Bethe hole 21 is provided with a sub-waveguide for measurement (not shown). In a plane where large planes of the sub-waveguide and the waveguide 14 are overlapped, small circular coupling holes are provided. The Bethe hole 21 output from the sub-waveguide, the high frequency power signal of the traveling wave leaked from the waveguide 14 via the coupling holes. The power of the high frequency power signal is in proportion to power of the high frequency power signal propagated in the waveguide 14. The atteneuator 22 is disposed in an output port of the Bethe hole 21, to attenuate the high frequency power signal outputted from the Bethe hole 21. The crystal element 23 converts the high frequency power signal outputted from the Bethe hole 21 into a monitor power signal. The coaxial cable 24 transmits the monitor power signal from the crystal element 23 to the oscilloscope 7. The power monitoring device 6 may be also replaced with another sensor by measuring the traveling wave power and the reflection wave power in the waveguide 14. The sensor is exemplified by a sensor provided with a directional coupler excluding the Bethe hole 21.

Figure 3:
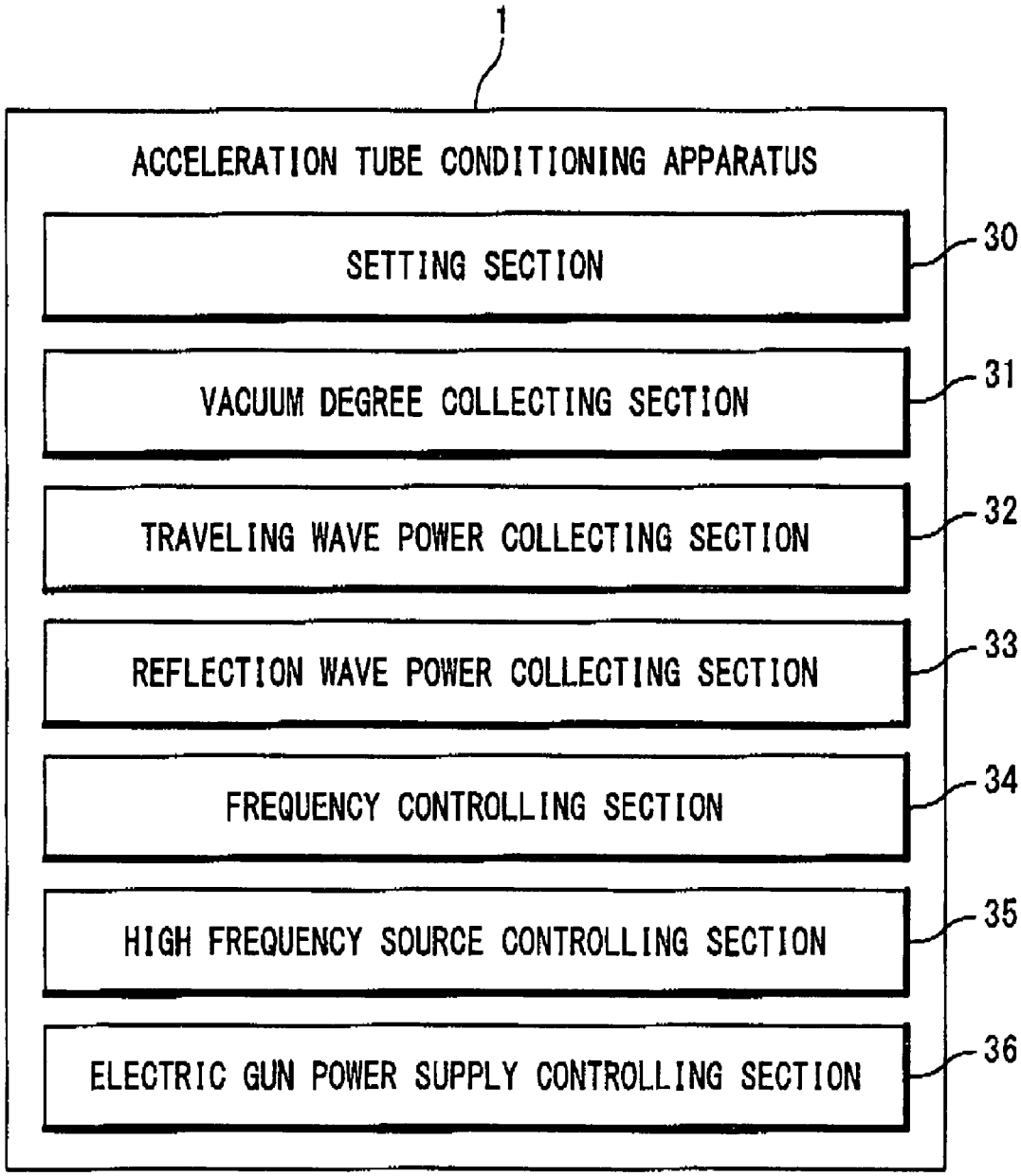
FIG. 3 is a block diagram showing a configuration the acceleration tube conditioning apparatus according to an embodiment of the present invention.

The acceleration tube conditioning apparatus 1 is a computer, and a plurality of computer programs are installed as shown in FIG. 3. That is, the acceleration tube conditioning apparatus 1 is provided with a CPU, a storage unit, an input unit, an output unit, and interface (all not shown). The CPU executes the computer programs installed in the acceleration tube conditioning apparatus 1 to control the storage unit, the input unit and the output unit. The storage unit stores the computer programs, and temporarily stores data generated by the CPU. The input unit outputs data generated by user operations to the CPU. The input unit is exemplified by keyboards and mice. The output unit outputs data generated by the CPU to the users in a recognizable manner. The output unit is exemplified by a display unit which displays the data generated by the CPU. The interface outputs to the CPU, the data generated by external units connected to the acceleration tube conditioning apparatus 1, and outputs the data generated by the CPU to the external units. The external units include the klystron power supply system 5, the traveling wave/reflection wave power monitoring device 6, the oscilloscope 7, the automatic frequency controller 8, the ion pump 11, and the electron gun power supply system 12.

The acceleration tube conditioning apparatus 1 is provided with a setting section 30, a vacuum degree collecting section 31, a traveling wave power collecting section 32, a reflection wave power collecting section 33, a frequency controlling section 34, a high frequency source controlling section 35, and an electron gun power supply controlling section 36.

The setting section 30 sets a plurality of values entered by the users who operates the input unit as a plurality of set values. The plurality of set values include an RF power initial value, a klystron voltage initial value, a pulse width initial value, a repetition frequency initial value, a first ion pump current upper limit, a second ion pump current upper limit, a first reflection waveform upper limit, a second reflection waveform upper limit, a duration time, a RF power upper limit, a target incident power, a target klystron voltage, a target pulse width, a traveling wave power specified level, a reflection wave power specified level, a repetition frequency specified level, and a target repetition frequency.

The vacuum degree collecting section 31 collects an ion pump current from the ion pump 11, and calculates the vacuum degree inside the cylinder of the acceleration tube 3 on the basis of the ion pump current. The traveling wave power collecting section 32 collects a change in the traveling wave power from the oscilloscope 7. The reflection wave power collecting section 33 collects a change in the reflection wave power from the oscilloscope 7.

If the traveling wave power collected by the traveling wave power collecting section 32 is smaller than the traveling wave power specified level set by the setting section 30, if the reflection wave power colleted by the reflection wave power collecting section 33 is smaller than the reflection wave power specified level set by the setting section 30, or if a repetition frequency collected from the klystron power supply system 5 is smaller than the repetition frequency specified level set by the setting section 30, the frequency controlling section 34 controls the automatic frequency controller 8 so that the automatic frequency controller 8 outputs a constant high frequency power signal which is independent from the powers measured by the traveling wave/reflection wave power monitoring device 6. Furthermore, if the traveling wave power collected by the traveling wave power collecting section 32 is larger than the traveling wave power specified level set by the setting section 30, the reflection wave power collected by the reflection wave power collecting section 33 is larger than the reflection wave power specified level set by the setting section 30, and the repetition frequency collected from the klystron power supply system 5 is larger than the repetition frequency specified level set by the setting section 30, the high frequency controlling section 34 controls the automatic frequency controller 8 so that the automatic frequency controller 8 outputs a frequency corresponding to the powers measured by the traveling wave/reflection wave power monitoring device 6. The frequency controlling section 34 further collects the frequency from the automatic frequency controller 8.

The high frequency source controlling section 35 starts the klystron power supply system 5 in response to a user operation of the input unit. The high frequency source controlling section 35 further controls the RF power, the klystron voltage, the repetition frequency and the pulse width on the basis of the plurality of set values set by the setting section 30, a vacuum degree collected by the vacuum degree collecting section 31, the traveling wave power collected by the traveling wave power collecting section 32, the reflection wave power collected by the reflection wave power collecting section 33, and the RF power, the klystron voltage, the klystron current, the pulse width and the repetition frequency collected from the klystron power supply system 5. The high frequency source controlling section 35 further controls the klystron power supply system 5 to output a high frequency power signal of the frequency collected by the frequency controlling section 34.

The electron gun power supply controlling section 36 controls the electron gun power supply system 12 so that the electron gun 15 discharges a predetermined amount of electrons inside the cylinder of the acceleration tube 3 in conditioning the acceleration tube 3. It is not necessarily required to discharge electrons inside the cylinder of the acceleration tube 3 in the conditioning the acceleration tube 3, and the electron gun power supply controlling section 36 controls the electron gun power supply system 12 to prevent the electron gun 15 from discharging electrons inside the cylinder of the acceleration tube 3 at this time.

According to the acceleration tube conditioning system 2 as described above, the acceleration tube conditioning apparatus 1 can control the klystron power supply system 5 by using measurement results measured by the traveling wave/reflection wave power monitoring device 6, and the acceleration tube 3 can be conditioned more stably by controlling the klystron power supply system 5 on the basis of operation condition of the klystron power supply system 5.

Figure 4A:
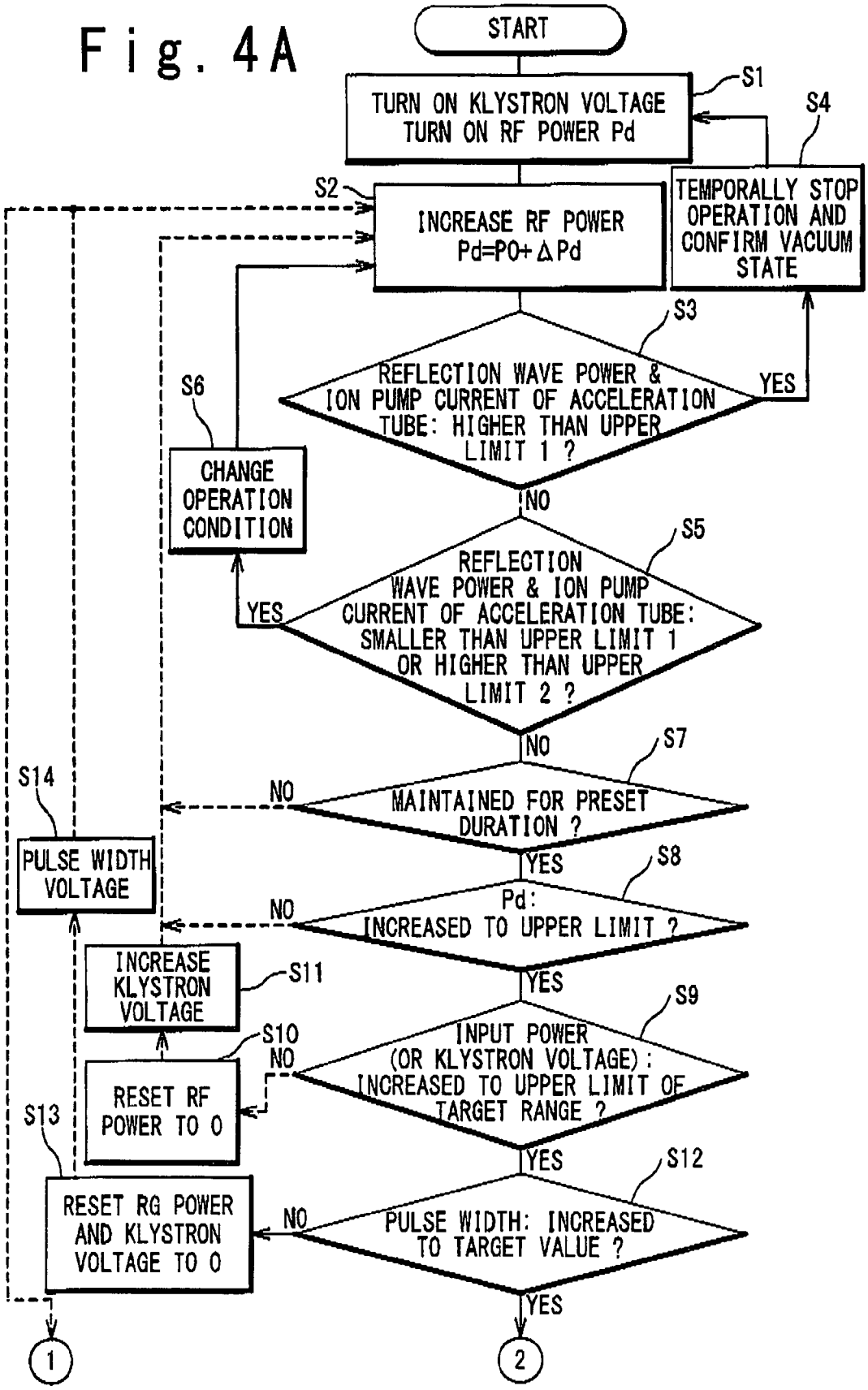
FIGS. 4A and 4B are a flowchart showing an operation of the acceleration tube conditioning system according to the embodiment of the present invention.
Figure 4B:
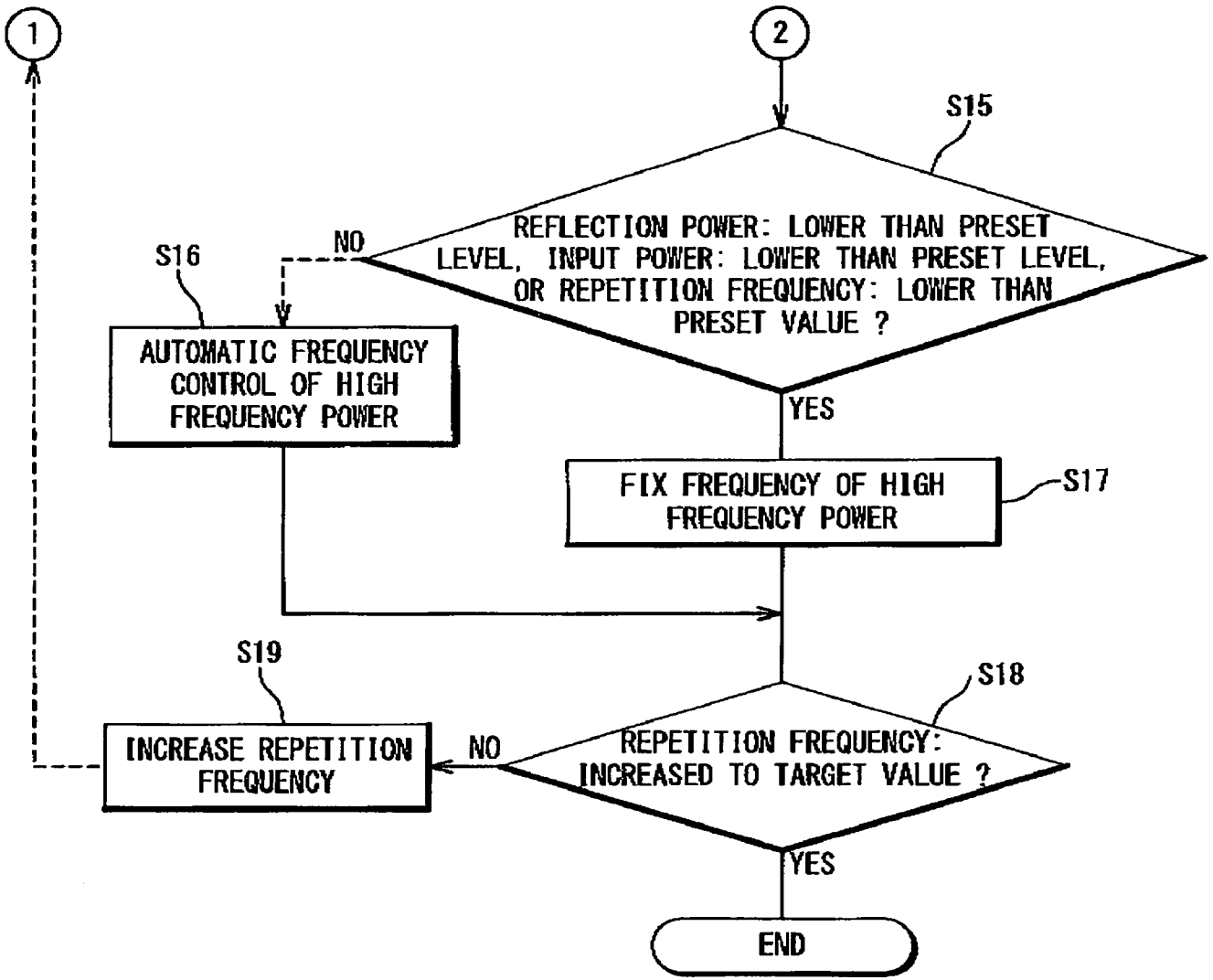

FIGS. 4A and 4B shows an acceleration tube conditioning method according to an embodiment of the present invention. The acceleration tube conditioning method according to the embodiment of the present invention is implemented by the acceleration conditioning system 2. A plurality of values are initially inputted as a plurality of set values by a user who operates the input unit of the acceleration tube conditioning apparatus 1. The plurality of values are composed of the RF power initial value, the klystron voltage initial value, the pulse width initial value, the repetition frequency initial value, the first ion pump current upper limit, the second ion pump current upper limit, the first reflection waveform upper limit, the second reflection waveform upper limit, the duration time, the RF power upper limit, the target incident power, the target klystron voltage, the target pulse width, the traveling wave power specified level, the reflection wave power specified level, the repetition frequency specified level, and the target repetition frequency. Subsequently, the user starts the ion pump 11 to exhaust gas inside the acceleration tube 3.

The acceleration tube conditioning apparatus 1 starts the klystron power supply system 5 in response to an operation by the user of the input unit, and sets the klystron power supply system 5 so that the RF power is set to the RF power initial value, the klystron voltage is set to the klystron voltage initial value, the pulse width is set to the pulse width initial value, and the repetition frequency is set to the repetition frequency initial value (step S1).

The acceleration tube conditioning apparatus 1 slightly increases the RF power when the klystron power supply system 5 is started (step S2). If a pump current collected from the ion pump 11 is larger than the first ion pump current upper limit, or if reflection wave power measured by the traveling wave/reflection wave power monitoring device 6 is larger than the first reflection waveform upper limit (step S3, YES), the acceleration tube conditioning apparatus 1 temporarily stops the acceleration tube conditioning method (step S4). At this time, the temporary stop state is maintained by the user until the vacuum degree becomes sufficiently high to a predetermined vacuum degree, and after confirming the vacuum degree inside the acceleration tube 3 has reached to the predetermined vacuum degree, the user operates the acceleration tube conditioning apparatus 1 to execute the step S1 again.

If an ion pump current collected from the ion pump 11 is smaller than the first ion pump current upper limit, and the reflection wave power measured by the traveling wave/reflection wave power monitoring device 6 is smaller than the first reflection waveform upper limit (step S3, NO), and if the ion pump current is larger than the second ion pump current upper limit, or if the reflection wave power is larger than the second reflection waveform upper limit (step S5, YES), the acceleration conditioning apparatus 1 changes the set values of the klystron power supply system 5 (step S6). Changing the set value suppresses an arc discharge generated in the acceleration tube 3. Such changing of the set values includes slightly decreasing the RF power, reducing the klystron voltage, and keeping the conditioning frequency away from a resonance frequency of the acceleration tube. The acceleration tube conditioning apparatus 1 executes the step S2 again after executing the step S6.

If the ion pump current collected from the ion pump 11 and the reflection wave power measured by the traveling wave/reflection wave power monitoring device 6 are not maintained for its duration or longer (step S7, NO), the acceleration tube conditioning apparatus 1 executes the step S2 again. Such a state indicates that an ion pump current collected from the ion pump 11 is larger than the second ion pump current upper limit, the ion pump current is smaller than the first ion pump current upper limit, the reflection wave power measured by the traveling wave/reflection wave power monitoring device 6 is larger than the second reflection waveform upper limit, and the reflection wave power is smaller than the first reflection waveform upper limit.

If the state is maintained for its duration or longer (step S7, YES), and if the RF power is not increased to the RF power upper limit (step S8, NO), the acceleration tube conditioning apparatus 1 executes the step S2 again.

If the RF power is increased to the RF power upper limit (step S8—YES), and if traveling wave power collected from the oscilloscope 7 is not increased to the target incident power, or if a klystron voltage collected from the klystron power supply system 5 is not increased to the target klystron voltage (step S9—NO), the acceleration tube conditioning apparatus 1 resets the RF power to 0 (step S10). Subsequently, the klystron voltage is increased (step S11), and then the step S2 is executed again.

If the traveling wave power collected from the oscilloscope 7 is increased to the target incident power and the klystron voltage collected from the klystron power source system 5 is increased to the target klystron voltage (step S9—YES), and if the pulse width collected from the klystron power supply system 5 is not increased to the target pulse width (step S12—NO), the acceleration tube conditioning apparatus 1 resets the RF power to 0, resets the klystron voltage to 0 (step S13), and increases the pulse width (step S14). Then, the step S2 is executed again.

When the pulse width collected from the klystron power supply system 5 is increased to the target pulse width (step S12, YES), if the traveling wave power measured by the traveling wave/reflection wave power monitoring device 6 is smaller than the traveling wave power specified level, the reflection wave power measured by the power monitoring device 6 is smaller than the reflection wave power specified level, or the repetition frequency collected from the klystron power supply system 5 is smaller than the repetition frequency specified level (step S15—YES), the acceleration tube conditioning apparatus 1 controls the automatic frequency controller 8 so that the automatic frequency controller 8 outputs a constant high frequency which is independent from the power measured by the power monitoring device 6 (step S17). If the traveling wave power is higher than the traveling wave power specified level, the reflection wave power is higher than the reflection wave power specified level, and the repetition frequency is higher than the repetition specified level (step S15—NO), the acceleration tube conditioning apparatus 1 controls the automatic frequency controller 8 so that the automatic frequency controller 8 outputs high frequency power signal corresponding to the power measured by the power monitoring device 6 (step S16). The acceleration tube conditioning apparatus 1 controls the klystron power supply system 5 to output the high frequency power signal having a high frequency specified from the automatic frequency controller 8.

If the repetition frequency collected from the klystron power supply system 5 is not increased to the target repetition frequency (step S18—NO), the acceleration tube conditioning apparatus 1 increases the repetition frequency (step S19). The conditioning of the acceleration tube 3 is supposed to be continued until all values of the RF power, the klystron voltage, the pulse width, and the repetition frequency are set to the respective target states through the execution of the steps S1 to S19 executed by the acceleration tube conditioning apparatus 1.

Figure 5:
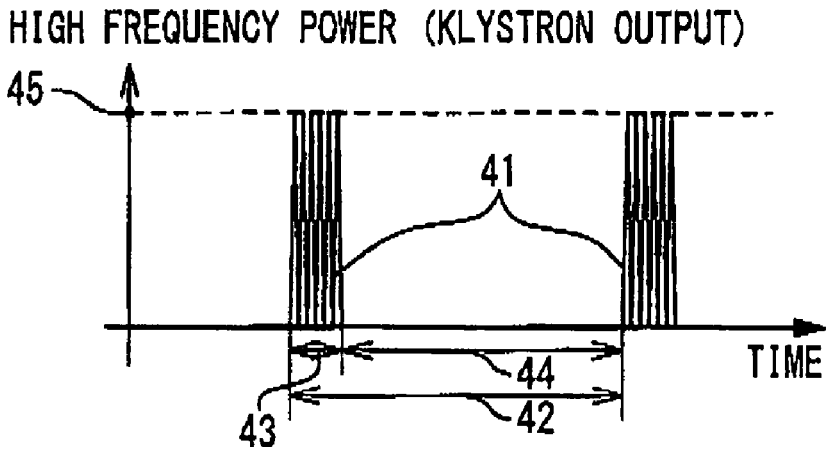
FIG. 5 is a timing chart showing changes in traveling wave power outputted from the klystron.

FIG. 5 shows changes in power of a high frequency power signal outputted from the klystron power supply system 5. FIG. 5 indicates that a same change is repeated for every period 42 in the high frequency power signal. The period 42 corresponds to a reciprocal of a repetition frequency of the klystron power supply system 5, and is composed of a period 43 and a period 44. The changes 41 indicate that the power signal vibrates between a peak value 45 and 0 for the period 43. The vibration period is sufficiently small in comparison with the period 42. The period 43 corresponds to a pulse width controlled by the acceleration tube conditioning apparatus 1. The changes 41 indicate that the power is substantially 0 for the period 44.

Figure 6:
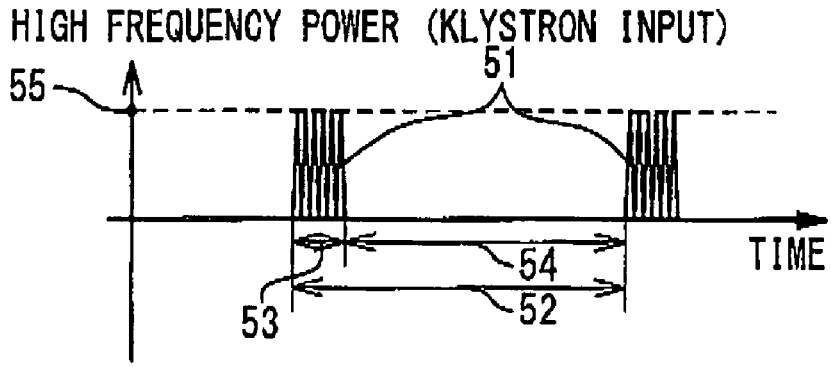
FIG. 6 is a timing chart showing changes in reflection wave power which is made incident to the klystron.

FIG. 6 shows changes in the reflection wave power which is made incident to the klystron power supply system 5 by reflection of a high frequency power signal outputted from the klystron power supply system 5 in the acceleration tube 3. FIG. 6 indicates that a same change is repeated for every period 52 in the reflection high frequency power signal. The period 52 is equivalent to the period 42, and is composed of a period 53 and period 54. The changes 51 indicate that the power signal vibrates between a peak value 55 and 0 for the period 53, and indicate that the power is substantially 0 for the period 54. The vibration period is sufficiently small in comparison with the period 52. The period 53 corresponds to a pulse width controlled by the acceleration tube conditioning apparatus 1. The changes 51 further indicate that the peak value 55 is smaller than the peak value 45.

Figure 7:
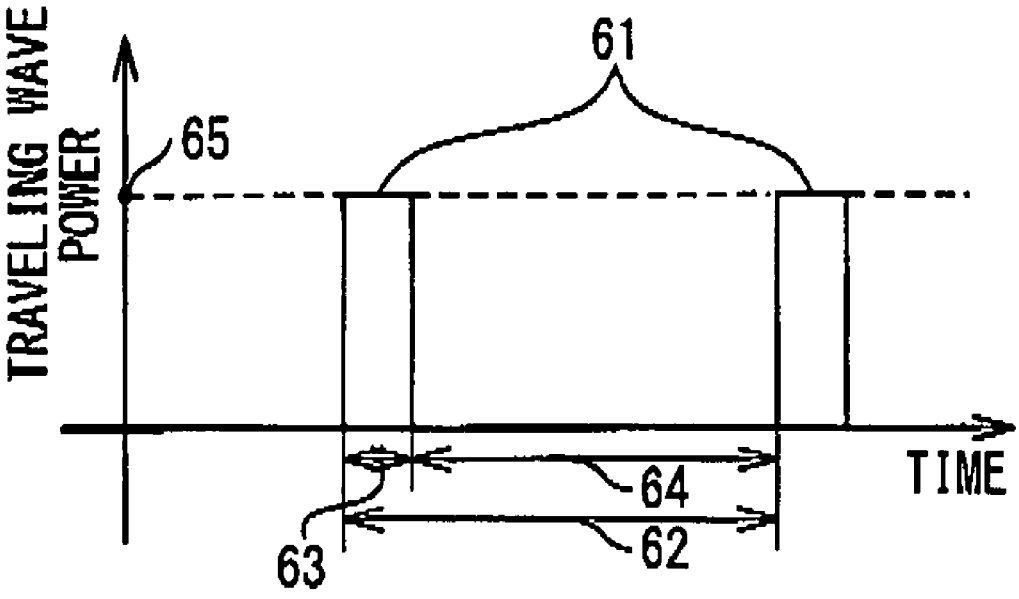
FIG. 7 is a diagram showing changes in traveling wave power measured by the power monitoring device.

FIG. 7 shows changes in the traveling wave power measured by the traveling wave/reflection wave power monitoring device 6, i.e. shows a waveform of the traveling wave power calculated by the oscilloscope 7. FIG. 7 indicates that a same change is repeated for every period 62 in the high frequency power signal. The period 62 is equivalent to the period 42, and is composed of a period 63 and period 64. The changes 61 indicate that the power signal has a peak value 65 for the period 63, and indicate that the power signal is substantially 0 for the period 64. The period 63 corresponds to a pulse width controlled by the acceleration tube conditioning apparatus 1. The changes 61 further indicate that the peak value 65 is substantially equivalent to the peak value 45.

Determination of resonance changes is generally more difficult when the traveling wave power is small, when the reflection wave power is small, or when the repetition frequency is small. When the traveling wave power is large, when the reflection wave power is large, or when the repetition frequency is large, the following phenomena are caused in the acceleration tube 3: a power load is large, temperatures increase is remarkable, thermal deformation is large, and the resonance frequencies largely changes. The acceleration tube conditioning method as described above allows more stable conditioning of the acceleration tube 3 by avoiding determination of resonance change when the traveling wave power is small, when the reflection wave power is small, or when the repetition frequency is small. According to the acceleration tube conditioning method as described above, the resonance change are determined when the traveling wave power is large, when the reflection wave power is large, or when the repetition frequency is large, the high frequency power signal can be more effectively changed so that more stable conditioning of the acceleration tube 3 is realized.

The vacuum degree of the acceleration tube 3 deteriorates when ark discharge is generated in the acceleration tube 3. According to the acceleration tube conditioning method as described above, when a small arc discharge is generated in the acceleration tube 3, acceleration tube conditioning apparatus 1 changes a conditioning state of the high frequency power signal so as to suppress the arc discharge. Thus, the generation of arc discharge sufficiently large to damage the acceleration tube 3 can be prevented. Therefore, the acceleration tube conditioning apparatus 1 can execute the steps S1 through S19 and prevents generation of large arc discharge which damages the acceleration tube 3, until all values of the RF power, the klystron voltage, the pulse width, and the repetition frequency are set to respective target states. Thus, more certain conditioning of the acceleration tube 3 can be achieved.

In conditioning the acceleration tube 3, when the klystron voltage is to be increased at first, rapid power increase is caused because of large dependence on incident power. Accordingly, there is a high risk of frequent discharge. Moreover, in conditioning the acceleration tube 3, if a pulse width is increased at first, discharge is easy to be maintained to cause significant damages in case of discharge generation. Furthermore, if a repetition frequency is increased at first, electric field is more frequently applied in a state that the electric field strength is unchanged inside the acceleration tube, so that a longer time is required for processes unable to perform in a low electric field strength such as degasification and activation improvement on the surface. In the acceleration tube conditioning method according to the present invention, the RF power is initially increased to attain the processes in an appropriate power increment.

If a pulse width is increased immediately after increasing the RF power, discharge is easily maintained, causing significant damages in case of discharge generation. If the repetition frequency is increased immediately after increasing the RF power, it causes more frequent electric field application in a state where electric field strength is unchanged inside the acceleration tube, so that a longer time is required for processes unable to perform in a low electric field strength such as degasification and an activation improvement on the surface. In the acceleration tube conditioning method according to the present invention, immediately after the RF power is increased, a klystron voltage is increased to slightly exceed a level in which the conditioning has been achieved. In this way, it is possible to attain the processes in an appropriate power increment.

In the acceleration tube conditioning method according to the present invention, after completion of conditioning to achieve a sufficient power level, the pulse width is increased and also the repetition frequency is increased. Thus, a stable conditioning process of the acceleration tube can be achieved to a pulse width and repetition frequency under an actual use condition. That is, in the acceleration tube conditioning method according to the present invention, adjustments is carried out in an order from the RF power to the klystron voltage to the repetition frequency to the pulse width, so that stepwise processes can be performed while suppressing a rapid increase of energy.

It should be noted that in the acceleration tube conditioning method according to the present invention, the process to increase a pulse width at the steps S12 through S14 may be replaced with the process to increase the repetition frequency at the steps S15 through S19. The acceleration tube conditioning method as described above can attain stepwise processes while suppressing the rapid increase of energy in a same manner as the acceleration tube conditioning method in the aforementioned embodiment.

Also, the acceleration tube conditioning apparatus 1 may determine whether the high frequency power signal is to be fixed or to be changed, on the basis of only the traveling wave power measured by the traveling wave/reflection wave power monitoring device 6 at the step S15. The acceleration tube conditioning apparatus 1 may further determine whether the high frequency power signal is to be fixed or to be changed on the basis of only the reflection wave power measured by the traveling wave/reflection wave power monitoring device 6 at the step S15. According to the acceleration tube conditioning method as described above, more reliable conditioning of the acceleration tube 3 can be attained in the same manner as the acceleration tube conditioning method in the above embodiment.

Next, the acceleration tube conditioning apparatus according to another embodiment of the present invention is further provided with a high frequency calculating unit in the acceleration tube conditioning apparatus 1 of the above-mentioned embodiments. The high frequency calculating unit calculates the high frequency power signal corresponding to the power measured by the traveling wave/reflection wave power monitoring device 6 and outputs the calculation result to the acceleration tube conditioning apparatus 1. The high frequency power signal is calculated to resonate in the acceleration tube 3 or to suppress resonance deviations. At this time, if the traveling wave power collected by the traveling wave power collecting section 32 is lower than the traveling wave power specified level set by the setting section 30, or if the reflection wave power collected by the reflection wave power collecting section 33 is lower than the reflection wave power specified level set by the setting section 30, or if the repetition frequency collected from the klystron power supply system 5 is lower than the repetition frequency specified level set by the setting section 30, the high frequency controlling section 34 outputs a constant high frequency which is independent from the high frequency calculated by the high frequency calculating unit. Furthermore, if the traveling wave power collected by the traveling wave power collecting section 32 is higher than the traveling wave power specified level set by the setting section 30, and the reflection wave power collected by the reflection wave power collecting section 33 is higher than the reflection wave power specified level set by the setting section 30, and the repetition frequency collected from the klystron power supply system 5 is higher than the repetition specified level set by the setting section 30, the high frequency controlling section 34 controls the klystron power supply system 5 to output a high frequency power signal having the high frequency calculated by the high frequency calculating unit. The acceleration tube conditioning apparatus as described above is preferable because it is not necessary to provide the automatic frequency controller 8 separately from the acceleration tube conditioning apparatus in the acceleration tube conditioning system 2.

In still another embodiment of the acceleration tube conditioning apparatus according to the present invention, the traveling wave power collecting section 32 in the above-mentioned embodiments is replaced with another traveling wave power collecting unit, and the reflection wave power collecting section 33 is replaced with another reflection wave power collecting section. The traveling wave power collecting section collects from the traveling wave/reflection wave power monitoring device 6 the traveling wave power measured by the traveling wave/reflection wave power monitoring device 6. The reflection wave power collecting section collects the reflection wave power measured by the power monitoring device 6. The acceleration tube conditioning apparatus as described above is preferable because it is not necessary to provide the oscilloscope 7 separately from the acceleration tube conditioning apparatus in the acceleration tube conditioning system 2.

The klystron power supply system 5 can be replaced with another high frequency source. The high frequency source is exemplified by an electron tube high frequency source and a magnetron. The high frequency source generates a predetermined high frequency power signal by controlling the RF power, an application voltage, a pulse width, a repetition frequency, and a high frequency in the same manner as the klystron power supply system 5. At this time, the acceleration tube conditioning apparatus 1 controls a high frequency source to output a predetermined high frequency power signal by outputting the RF power, the application voltage, the pulse width, the repetition frequency, and the high frequency to the high frequency source in the same manner as the klystron power source system 5.

The traveling wave/reflection wave power monitoring device 6 provided with a directional coupler (−60 dB) of the Bethe hole system is applied to an implementation example of the acceleration tube conditioning apparatus according to the present invention. Ranges used in a conditioning process are as follows: a klystron voltage of 80 to 130 kV, klystron input high frequency power of 0 to 150 W, pulse width of 1 to 4 μs, klystron repetition frequency of 10 to 300 pps, and high frequency input power of 0 to 2.5 MW to the acceleration tube 3.

In the implementation example of the acceleration tube conditioning method according to the present invention, an ion current in the ion pump which performs high vacuum evacuation of the acceleration tube is monitored and sent to a controller as an input signal. When discharge is generated inside the acceleration tube, a pressure inside the acceleration tube increases due to generation of degasification, and the increased pressure also increases a current value. Therefore, if the current exceed a set threshold value $I_1$, transmission power of a main waveguide for transmitting power as high frequency input power to the acceleration tube is decreased, so that the high frequency input power to the klystron is set to be decreased by about 2 to 3 W in order to continue conditioning. At this time, under the condition that no load is applied to the acceleration tube (i.e., output of the electron gun is 0), it becomes possible to achieve the conditioning process including a series of processes until a maximum set condition of the acceleration tube without executing a reconditioning process in power whose level is substantially lower than a high frequency power level obtained immediately before discharge generation. An automatic conditioning process is executed to increase transmission power input of the main waveguide which is the high frequency input power to the acceleration tube to 2.5 MW, while monitoring and confirming the automatic conditioning process in real time.

In the acceleration tube conditioning method according to still another embodiment of the present invention, ion current of the ion pump which performs high vacuum evacuation of the acceleration tube are monitored is monitored and the monitored result is sent to a controller as an input signal. If the currents exceed the set threshold value $I_1$, transmission power of the main waveguide as the high frequency input power to the acceleration tube is decreased to 0 W to stop or suspend the execution of the conditioning process. Then, when the high frequency input power to the klystron is decreased to 0 W to recover a state of a threshold value $I_2$ or lower, the high frequency input power to the klystron is set to the level before the stop of the execution to restart the execution of the conditioning process. At this time, in the condition that no load is applied to the acceleration tube (i.e., output of the electron gun is 0), it becomes possible to achieve the conditioning process including a series of processes until a maximum set condition of the acceleration tube without executing a reconditioning process in the power whose level is substantially lower than the high frequency power level immediately before discharge generation. It becomes possible to realize an automatic conditioning process to increase transmission power input of the main waveguide as the high frequency input power to the acceleration tube up to 2.5 MW in real time while monitoring and confirming the process.

In the acceleration tube conditioning method according to a still another embodiment of the present invention, the conditioning process is implemented by fixing the frequency (to 5714 MHz) of the high frequency input power to a klystron if the high frequency input power is lower than 20 W (about 1 MW at maximum) and by performing a automatic high frequency adjustment in case of 20 W or larger. At this time, on the condition that no load is applied to the acceleration tube (i.e., output of the electron gun is 0), it becomes possible to realize an automatic conditioning process to increase the transmission power input of the main waveguide as the high frequency input power to the acceleration tube up to 2.5 MW.

In the acceleration tube conditioning method according to a further another example of the present invention, the conditioning process is implemented by fixing the frequency (to 5714 MHz) of the high frequency input power to the klystron if it is lower than 20 W (about 1 MW at maximum) and by performing an automatic high frequency adjustment in case of 20 W or larger. At this time, on the condition that no load is applied to the acceleration tube (i.e., output of the electron gun is 0), it becomes possible to realize an automatic conditioning process to increase the transmission power input of the main waveguide as the high frequency input power to the acceleration tube up to 2.5 MW.

In the acceleration tube conditioning apparatus and the acceleration tube conditioning method according to the present invention, it becomes possible to realize more stable and reliable conditioning of an acceleration tube which accelerates charged particles based on a high frequency input power.

What is claimed is:

1. An acceleration tube conditioning apparatus for performing a conditioning process on an acceleration tube when a high frequency power signal to be supplied to an acceleration tube is generated by a high frequency power supply, wherein said high frequency power signal is supplied to said acceleration tube as a traveling wave power signal and said traveling wave power signal is reflected in said acceleration tube as a reflection wave power signal, said acceleration tube conditioning apparatus comprising:

a power value collecting section configured to collect a traveling wave power value and a reflection wave power value from a sensor which monitors said traveling wave power signal and said reflection wave power signal;

a high frequency calculating section configured to calculate a resonance frequency of said acceleration tube based on said traveling wave power value and said reflection wave power value;

a high frequency adjusting section configured to determine a high frequency value based on one of said traveling wave power value and said reflection wave power value as a selection power value; and a high frequency power supply control unit configured to control said high frequency power supply based on said high frequency value, wherein said high frequency value indicates a constant value when said selection power value is smaller than a predetermined value, and indicates the calculated resonance frequency when said selection power value is larger than the predetermined value.

2. The acceleration tube conditioning apparatus according to claim 1, further comprising:

a vacuum degree collecting section configured to collect a vacuum degree in said acceleration tube, and wherein said high frequency power supply control unit controls said high frequency power supply to change said high frequency power signal when said vacuum degree degrades from a predetermined vacuum degree.

3. The acceleration tube conditioning apparatus according to claim 2, wherein said high frequency power supply control unit controls said high frequency power supply to change an RF power of said high frequency power signal, then to change a DC voltage used when said high frequency power signal is generated, and then to change a repetition frequency when said high frequency power signal is generated intermittently and periodically, or a pulse width of said high frequency power signal.

4. The acceleration tube conditioning apparatus according to claim 1, further comprising:

a vacuum degree collecting section configured to collect a vacuum degree in said acceleration tube, and wherein said high frequency power supply control unit controls said high frequency power supply to stop supply of said high frequency power signal to said acceleration tube when said vacuum degree degrades from a predetermined vacuum degree.

5. An acceleration tube conditioning apparatus for performing a conditioning process on an acceleration tube when a high frequency power signal to be supplied to an acceleration tube is generated by a high frequency power supply, wherein said high frequency power signal is supplied to said acceleration tube as a traveling wave power signal and said traveling wave power signal is reflected in said acceleration tube as a reflection wave power signal, said acceleration tube conditioning apparatus comprising:

a power value collecting section configured to collect a traveling wave power value and a reflection wave power value from a sensor which monitors said traveling wave power signal and said reflection wave power signal;

a high frequency calculating section configured to determine a resonance frequency of said acceleration tube based on said traveling wave power value and said reflection wave power value;

a high frequency adjusting section configured to generate a high frequency value based on a repetition frequency when said high frequency power supply generates said high frequency power signal intermittently and periodically; and a high frequency power supply control unit configured to control said high frequency power supply based on said high frequency value, wherein said high frequency value indicates a constant value when said repetition frequency is smaller than a predetermined value, and indicates said resonance frequency of said acceleration tube when said repetition frequency is larger than the predetermined value.

6. The acceleration tube conditioning apparatus according to claim 5, further comprising:

a vacuum degree collecting section configured to collect a vacuum degree in said acceleration tube, and wherein said high frequency power supply control unit controls said high frequency power supply to change said high frequency power signal when said vacuum degree degrades from a predetermined vacuum degree.

7. The acceleration tube conditioning apparatus according to claim 5, further comprising:

a vacuum degree collecting section configured to collect a vacuum degree in said acceleration tube, and wherein said high frequency power supply control unit controls said high frequency power supply to stop supply of said high frequency power signal to said acceleration tube when said vacuum degree degrades from a predetermined vacuum degree.

8. An acceleration tube conditioning system comprising:

an acceleration tube;

a high frequency power supply configured to generate a high frequency power signal;

a sensor configured to measure a traveling wave power value or reflection wave power value of said high frequency power signal in said acceleration tube; and an acceleration tube conditioning apparatus configured to control said high frequency power supply, wherein said acceleration tube conditioning apparatus comprises:

a power value collecting section configured to collect said traveling wave power value and said reflection wave power value from said sensor;

a high frequency calculating section configured to calculate a resonance frequency of said acceleration tube based on said traveling wave power value and said reflection wave power value; and a high frequency adjusting section configured to determine a high frequency value; and a high frequency power supply control unit configured to control said high frequency power supply based on said high frequency value.

9. The acceleration tube conditioning system according to claim 8, wherein said high frequency adjusting section determines said high frequency value based on one of said traveling wave power value and said reflection wave power value as a selection power value; and wherein said high frequency value indicates a constant value when said selection power value is smaller than a predetermined value, and indicates the calculated resonance frequency when said selection power value is larger than the predetermined value.

10. The acceleration tube conditioning system according to claim 8, wherein said high frequency adjusting section generates said high frequency value based on a repetition frequency when said high frequency power supply generates said high frequency power signal intermittently and periodically, and wherein said high frequency value indicates a constant value when said repetition frequency is smaller than a predetermined value, and indicates said resonance frequency of said acceleration tube when said repetition frequency is larger than the predetermined value.

11. An acceleration tube conditioning method of performing a conditioning process on an acceleration tube when a high frequency power signal to be supplied to an acceleration tube is generated by a high frequency power supply, wherein said high frequency power signal is supplied to said acceleration tube as a traveling wave power signal and said traveling wave power signal is reflected in said acceleration tube as a reflection wave power signal, said acceleration tube conditioning method comprising:

collecting a traveling wave power value and a reflection wave power value from a sensor which monitors said traveling wave power signal and said reflection wave power signal;

calculating a resonance frequency of said acceleration tube based on said traveling wave power value and said reflection wave power value;

determining a high frequency value based on one of said traveling wave power value and said reflection wave power value as a selection power value; and controlling said high frequency power supply based on said high frequency value, wherein said high frequency value indicates a constant value when said selection power value is smaller than a predetermined value, and indicates the calculated resonance frequency when said selection power value is larger than the predetermined value.

12. The acceleration tube conditioning method according to claim 11, further comprising:

collecting a vacuum degree in said acceleration tube, and wherein said controlling comprises:

controlling said high frequency power supply to change said high frequency power signal when said vacuum degree degrades from a predetermined vacuum degree.

13. The acceleration tube conditioning method according to claim 12, wherein said controlling comprises:

controlling said high frequency power supply to change an RF power of said high frequency power signal, then to change a DC voltage used when said high frequency power signal is generated, and then to change a repetition frequency when said high frequency power signal is generated intermittently and periodically, or a pulse width of said high frequency power signal.

14. The acceleration tube conditioning method according to claim 11, further comprising:

collecting a vacuum degree in said acceleration tube, and wherein said controlling comprises:

controlling said high frequency power supply to stop supply of said high frequency power signal to said acceleration tube when said vacuum degree degrades from a predetermined vacuum degree.

15. An acceleration tube conditioning method of performing a conditioning process on an acceleration tube when a high frequency power signal to be supplied to an acceleration tube is generated by a high frequency power supply, wherein said high frequency power signal is supplied to said acceleration tube as a traveling wave power signal and said traveling wave power signal is reflected in said acceleration tube as a reflection wave power signal, said acceleration tube conditioning method comprising:

collecting a traveling wave power value and a reflection wave power value from a sensor which monitors said traveling wave power signal and said reflection wave power signal;

determining a resonance frequency of said acceleration tube based on said traveling wave power value and said reflection wave power value;

determining a high frequency value based on a repetition frequency when said high frequency power supply generates said high frequency power signal intermittently and periodically; and controlling said high frequency power supply based on said high frequency value, wherein said high frequency value indicates a constant value when said repetition frequency is smaller than a predetermined value, and indicates said resonance frequency of said acceleration tube when said repetition frequency is larger than the predetermined value.

16. The acceleration tube conditioning method according to claim 15, further comprising:

collecting a vacuum degree in said acceleration tube, and wherein said controlling comprises:

controlling said high frequency power supply to change said high frequency power signal when said vacuum degree degrades from a predetermined vacuum degree.

17. The acceleration tube conditioning method according to claim 15, further comprising:

collecting a vacuum degree in said acceleration tube, and wherein said controlling comprises:

controlling said high frequency power supply to stop supply of said high frequency power signal to said acceleration tube when said vacuum degree degrades from a predetermined vacuum degree.

* * * * *